United States Patent [19]

Gonzales

[11] 4,202,072

[45] May 13, 1980

[54] ANTIFREEZE MEANS FOR CAR-WASH WET-VACUUM CLEANING MACHINES

[76] Inventor: Albert S. Gonzales, 11521 Morenci N.E., Albuquerque, N. Mex. 87112

[21] Appl. No.: 4,407

[22] Filed: Jan. 18, 1979

[51] Int. Cl.[2] ..... A47L 5/38; B08B 5/00

[52] U.S. Cl. ..... 15/302; 15/314; 15/321; 15/322; 15/339

[58] Field of Search ..... 15/321, 322, 302, 314

[56] References Cited

U.S. PATENT DOCUMENTS

| | | | |
|---|---|---|---|
| 3,461,478 | 8/1969 | Taylor | 15/302 |
| 3,538,535 | 11/1970 | Ginsburgh et al. | 15/302 |
| 4,153,968 | 5/1979 | Perkins | 15/321 |

*Primary Examiner*—Christopher K. Moore
*Attorney, Agent, or Firm*—Freilich, Hornbaker, Wasserman, Rosen & Fernandez

[57] ABSTRACT

A self-service, wet-vacuum cleaning machine for carpets, upholstery, and the like, utilizes a hand-held tool attached to both a vacuum hose and a hot water hose. A motor driven pump operates for a metered time to provide hot water under a high pressure in a direction that closes a valve in the hand tool to prevent spraying until it is called for by manually unseating the valve, thus allowing hot water to be sprayed on an area to be cleaned by wet-vacuuming. A spring in the valve housing exerts a force against the valve in a direction to unseat it, but not with sufficient force to do so against the hot water pressure. When the hot water pump is turned off, cold water under line pressure enters the hot-water hose through a T-fitting at a controlled low rate and passes through the valve now opened by the spring. This flow at a low rate prevents freezing in the hot water hose or spray valve.

5 Claims, 6 Drawing Figures

3-3

4-4

ANTIFREEZE MEANS FOR CAR-WASH WET-VACUUM CLEANING MACHINES

BACKGROUND OF THE INVENTION

This invention relates to a coin-operated, car-wash wet-vacuum cleaning machine, and more particularly to means in the machine for preventing a hot-water hose and spray valve from freezing between operations during cold weather.

Coin-operated vacuum cleaners are often installed at self-service car washes for the purpose of cleaning carpets and upholstery in automobiles, motor homes, vans, recreational vehicles, or any type of vehicle with carpet or upholstery, including boats or trailers. With the development of wet and dry vacuum cleaners for floor carpets, there has been a demand for similar carpet cleaning machines in coin-operated car wash bays. The technique is to supply hot water under pressure to a manually operated valve for spraying. Soap is mixed with the hot water sprayed to effect better cleaning. The dirty water is then vacuumed into a cannister and later discharged.

A problem arises in utilizing this wet-vacuum cleaning technique in open car-wash bays during cold weather since enough time may lapse between customers to allow the water in the line to the spray valve to freeze. This problem is exacerbated by the small diameter of the hot water line to the spray valve, and length of that line provided to allow areas in the far reaches of the vehicle to be cleaned. Yet there is a demand for self-service wet-vacuum cleaners in car washes during cold weather.

OBJECT AND SUMMARY OF THE INVENTION

An object of this invention is to provide a wet-vacuum cleaning machine with means for preventing the hot water line and spray valve from freezing between uses in cold weather.

Another object is to provide an improved spray valve for manual control of spraying at a hand-held tool in a wet-vacuum cleaning machine.

These and other objects of the invention are achieved by a hand-held tool in a wet-vacuum machine that incorporates not only a spray nozzle and a vacuum nozzle, but also a manually operated spray control valve which seats under hot-water pressure during use. A valve stem protrudes through the valve housing to allow the valve to be unseated against the hot water pressure during use. A spring is also provided to open the valve, but with insufficient force to open it against the hot water pressure. When the cleaning machine is not in use, and the hot water pressure is removed, the valve is opened by the spring against low cold water pressure provided through a T-fitting near the hot water source from a water supply line. A valve in the cold water line to the T-fitting, is used to adjust the flow through the open spray valve to a rate just sufficient to prevent freezing.

The novel features of the invention are set forth with particularity in the appended claims. The invention will best be understood from the following description when read in conjunction with the accompanying drawings.

DESCRIPTION OF PREFERRED EMBODIMENTS

Figure 1:
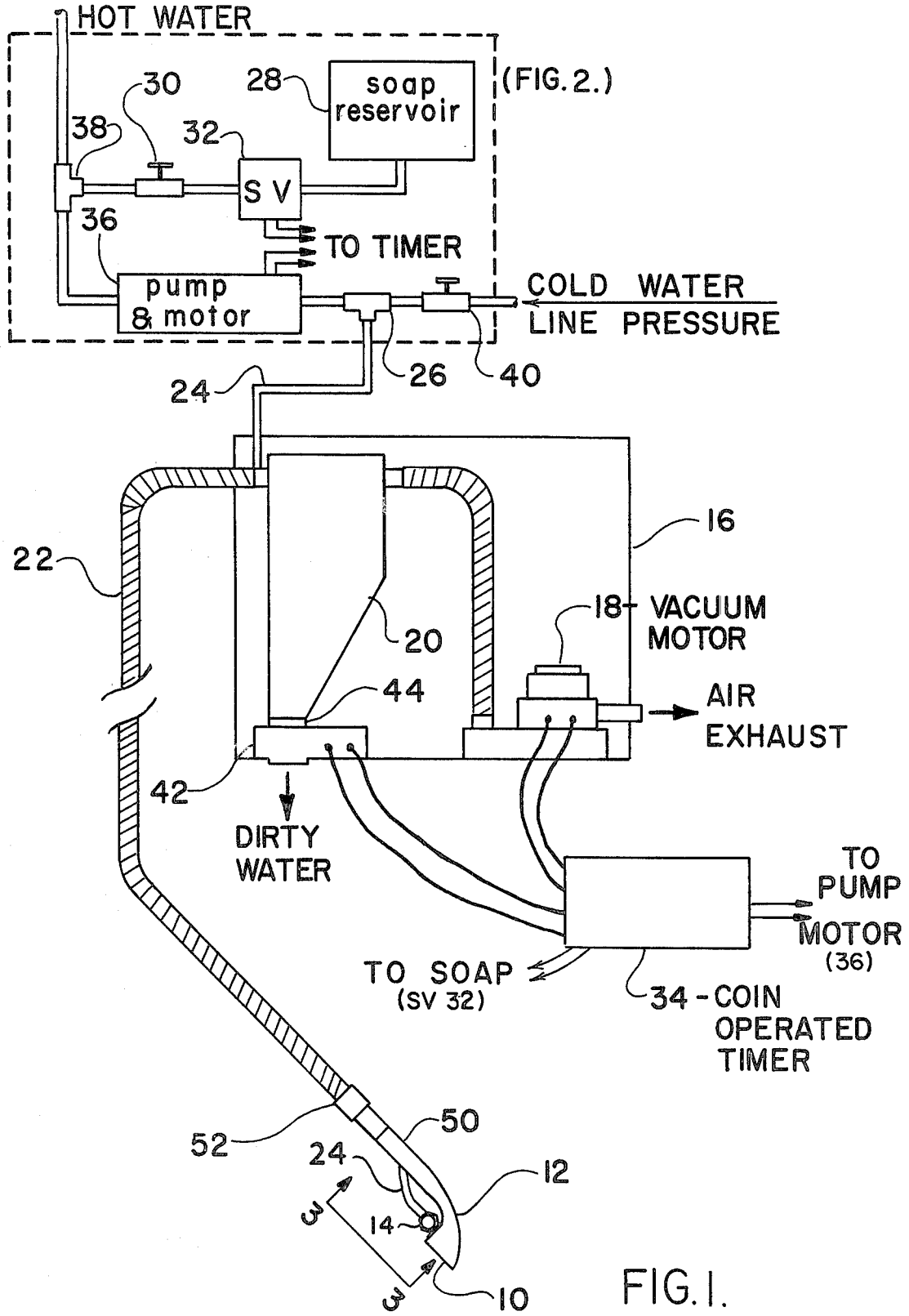
FIG. 1 is a functional block diagram of a wet-vacuum cleaning machine incorporating the present invention.

Referring now to FIG. 1, a coin-operated wet-vacuum cleaning system is adapted to be installed in an open bay of a self-service car wash for hot water extraction cleaning of carpets, upholstery, and the like. It cleans by spraying hot water through a nozzle next to a vacuum nozzle 10 and simultaneously vacuuming the dirty water as the hand tool 12, which includes a valve 14 for manual control of the spraying, is moved over an area for vacuum cleaning. When the manual valve is released, it closes under the hot water pressure, as will be described more fully hereinafter with reference to FIGS. 3, 4 and 5.

A vacuum machine 16 is designed to be placed in the car-wash bay attached to a wall or support structure. The vacuum machine is comprised of a vacuum motor 18 that creates a vacuum in a tank 20, which in turn provides suction at the hand tool 12 through a flexible hose 22. The hand tool is placed with the vacuum nozzle on the carpet or upholstery to be cleaned, and used for dry-vacuum cleaning an area before wet-vacuum cleaning. For wet-vacuum cleaning, the spring valve 14 is actuated (by pressing in on a plunger not shown in FIG. 1) to spray hot water supplied to a spray nozzle near the vacuum nozzle. By moving the vacuum nozzle over the area to be cleaned as hot water is sprayed, the hot water (mixed with soap) lifts dirt which is then vacuumed with the sprayed water into a tank 20.

The hot water is supplied through a small plastic or rubber hose 24 from a T-fitting 26 after soap from a reservoir 28 has been added at a rate set by a control valve 30, but only while a solenoid valve 32 is energized by a coin operated timer 34. The timer also energizes a pump motor 36 while the vacuum motor 18 is energized. A T-fitting 38 serves to mix the soap with hot water going into the pump motor. The pressurized hot water and soap mixture flows through the T-fitting 26 and there blocks the flow of cold water at lower line pressure.

The cold water line is connected to that T-fitting 26 so that when the coin-operated timer has metered an allotted period, such as five minutes, and the pump motor is turned off, cold water at a lower pressure will flow through the line 24 and the specially designed spray valve 14. The cold water flow is controlled by a valve 40 at a rate just enough to prevent freezing of water in the line and spray valve. Soap is not lost during this period of non-use because the solenoid valve 32 is deenergized when the pump and vacuum motors are deenergized. A solenoid drain valve 42 (energized to close a drain pipe 44 from the tank 20 during use of the wet-vacuum cleaning machine, i.e., while the vacuum pump is energized) is also deenergized at the end of the metered period to allow the drain valve to automatically open and discharge accumulated dirty water.

The drain valve 42 may be implemented with a sliding gate valve that is held open by a spring, and pulled closed against the force of the spring by a solenoid. The soap valve may be similarly implemented. Other ways of implementing these valves may occur, or be known, to those skilled in the art. Consequently, it is to be expressly understood that the implementation suggested is by way of example, and not limitation.

Figure 2:
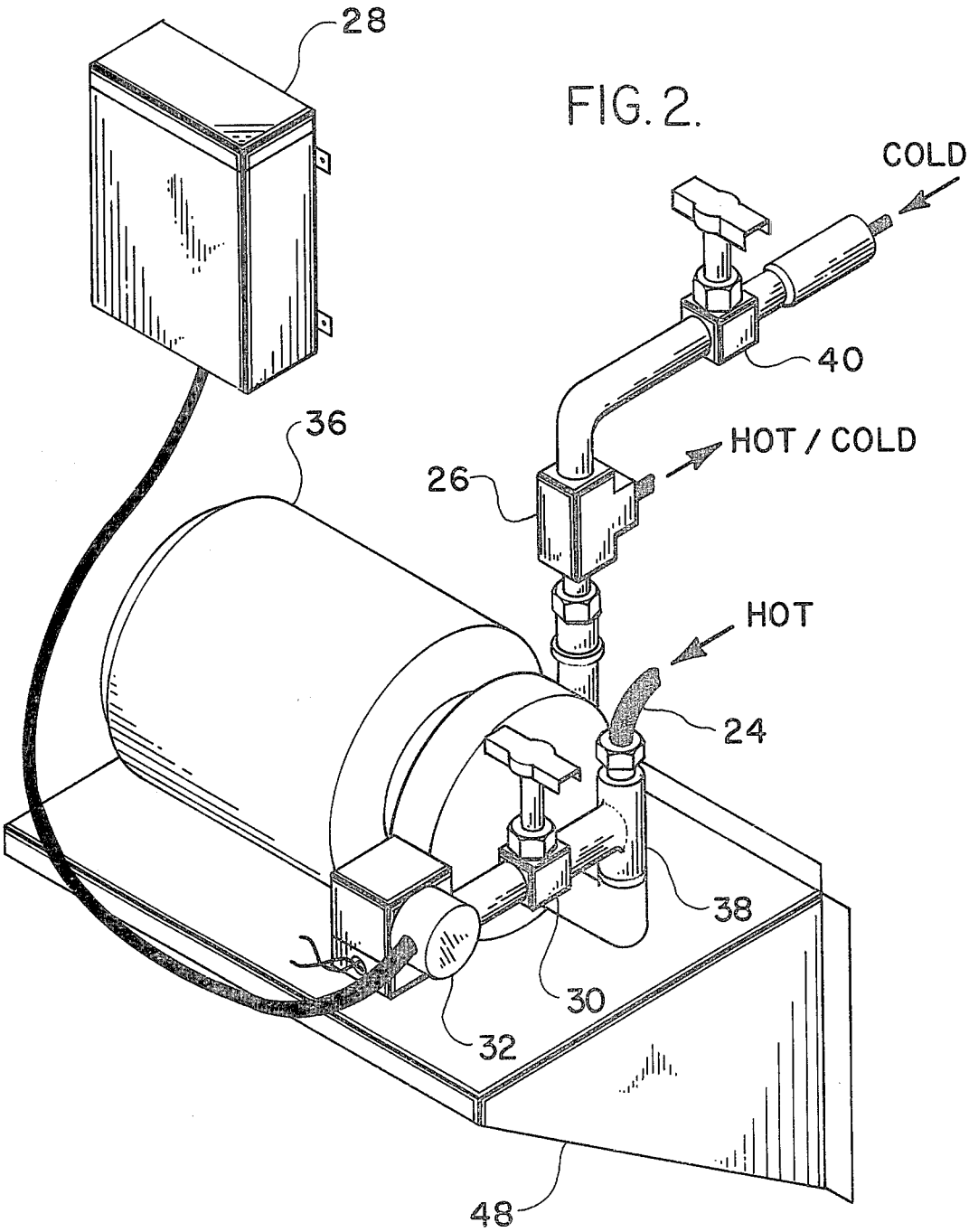
FIG. 2 is an isometric view of a portion of the system of FIG. 1 which is protected against weather.

All of the components of the system within the dashed line in FIG. 1 are closely grouped together and mounted in a position to receive hot and cold water directly from sources protected aginst the weather, such as by a structure provided to house the hot water heater (not shown). FIG. 2 shows these components supported on a bracket 48 adapted to be secured to a wall. The soap reservoir 28 is itself secured to the wall. The vacuum machine 16 (FIG. 1) may also be secured to the wall if that wall is sufficiently close to where the vehicle is to be stationed for cleaning, or to another wall or post at the cleaning station. In either case, the water line 24 is provided with sufficient length equal to that of the vacuum hose 22. The coin-operated timer is then mounted on the vacuum machine 16 at the cleaning station, and preferably inside the door of the enclosure for the cleaning machine 16, with only the mechanism for receiving the coins protruding from the enclosure. This is to provide added security for the coin box and timer since the enclosure for the vacuum machine 16, including the door, will be made of heavy gauge steel. Heavy hinges and a suitable lock are provided to make the door secure.

Figure 3:
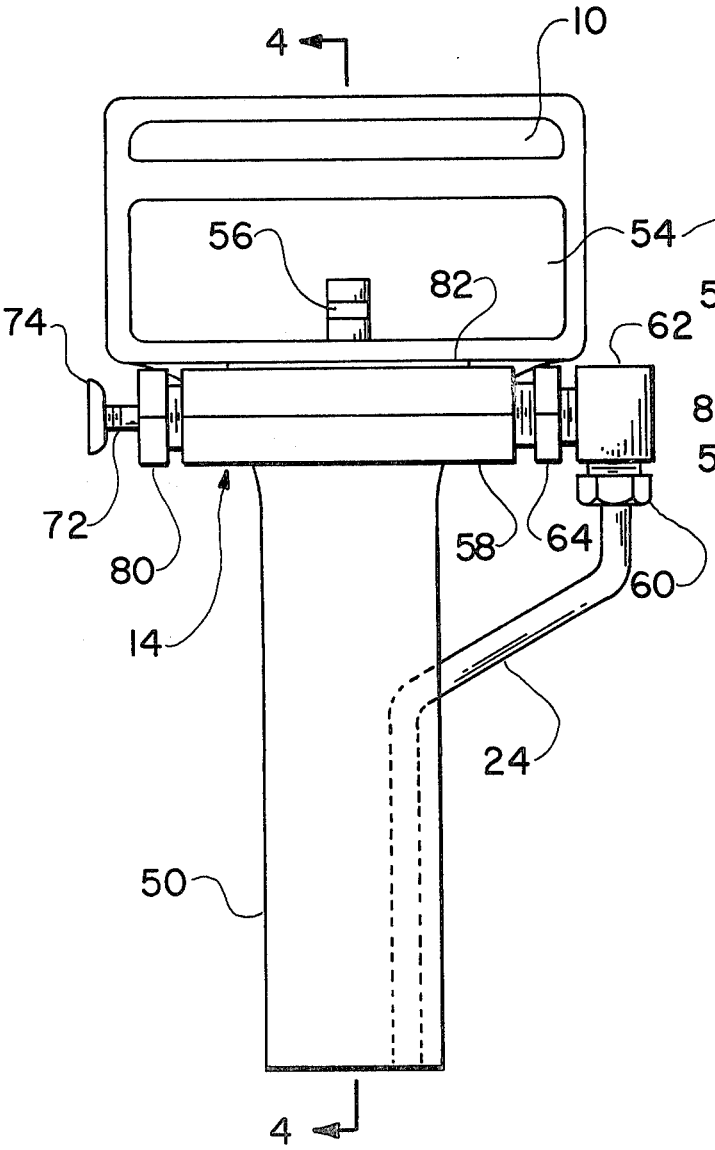
FIG. 3 is a view of a hand-held tool in the system indicated by a line 3—3 in FIG. 1.
Figure 4:
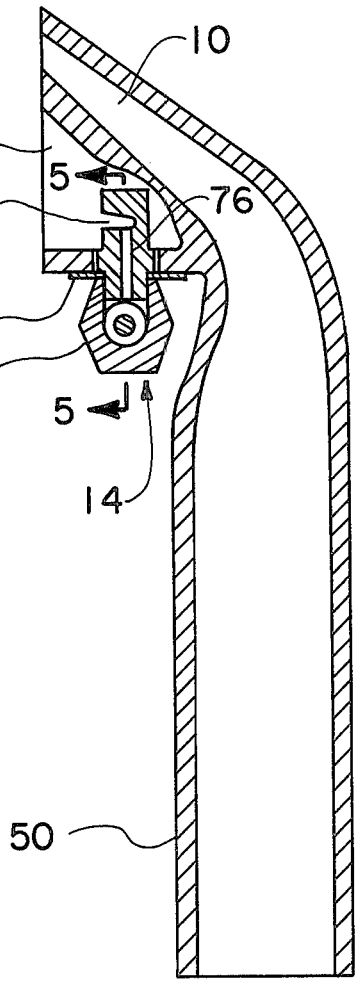
FIG. 4 is a sectional view of the hand-held tool taken along a line 4—4 in FIG. 3.
Figure 5:
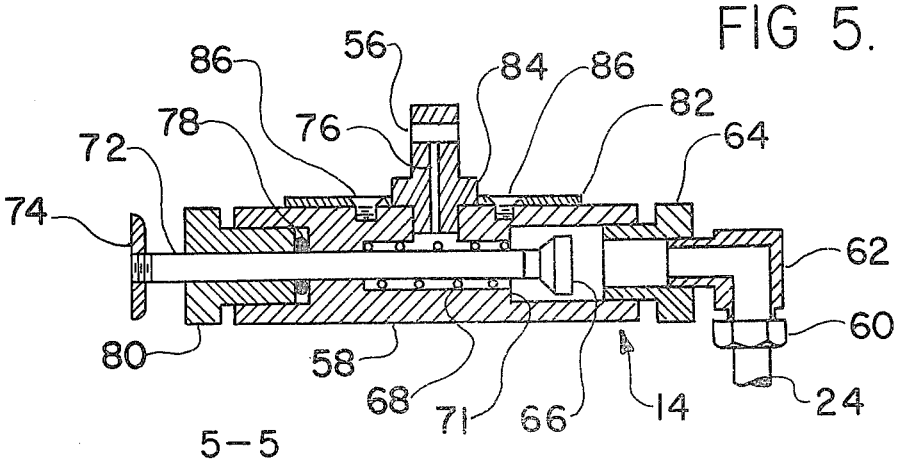
FIG. 5 is a sectional view of a manually operated spray valve on the hand-held tool taken along a line 5—5 in FIG. 4.

Referring not to FIG. 3, which shows the hand tool from a view taken along a line 3—3 in FIG. 1, and to FIG. 4, which is a cross section of the hand tool taken along a line 4—4 in FIG. 3, the vacuum nozzle 10 is formed on the end of a tube 50 which fits into a coupling 52 (FIG. 1) on the end of the hose 22. Below the vacuum nozzle is an open chamber 54 into which a spray nozzle 56 protrudes to spray a mixture of hot water and soap into the carpet, upholstery, or the like, to lift dirt that is then vacuumed with the water through the nozzle 10. The spray nozzle is threaded into the body 58 of the spray valve 14, and hot water line 24 is connected to the valve body by suitable fittings 60, 62 and 64, as shown in FIG. 5.

Hot water entering the valve body at one end directs hot water under pressure against a valve disc 66 to seat it against the force of a spring 68 over a valve seat 71 formed in the valve body. A valve stem 72 extends through the spring 68 and the valve body 58 to allow the valve to be opened by pushing on a button 74. Hot water will then flow past the valve disc 66, around the spring 68 and through a passage 76 to the spray valve 56, but only while the operator continues to push the button. An O-ring 78 compressed by a fitting 80, prevents hot water from leaking around the valve stem 72. When the hot water pump is turned off, pressure forcing the valve disc 66 against the valve seat 71 will drop, allowing the force of the spring 68 to open the valve and allow water from the cold water line valve 40 (FIG. 1) to flow through the line 24 and out of the spray valve 56. The rate of flow is adjusted at the valve 40 to the minimum level required to prevent water in the line and valve from freezing, as noted hereinbefore.

Figure 6:
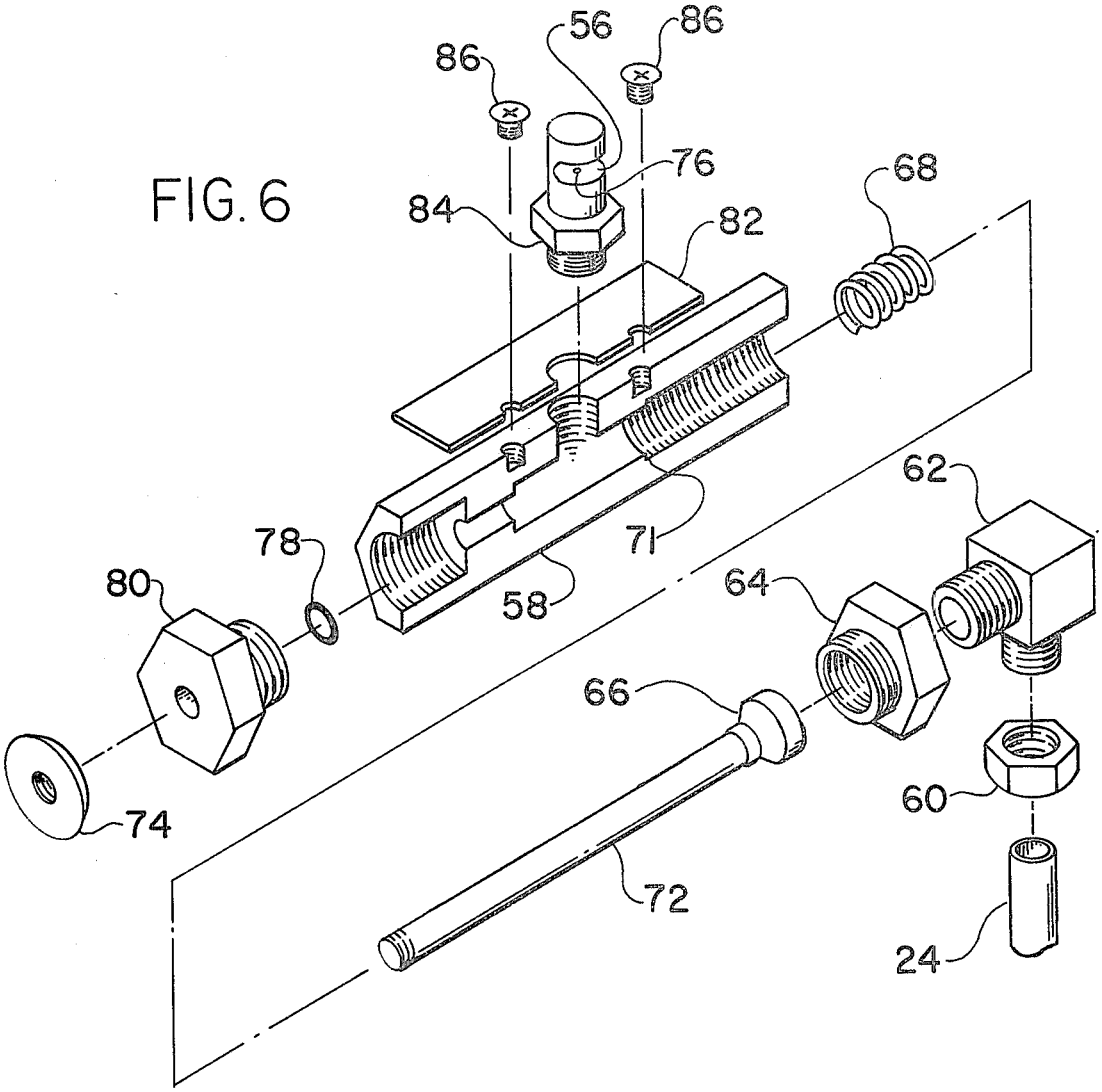
FIG. 6 is an exploded view of the valve shown in FIG. 5.

A plate 82 is secured to the valve body by a nut 84 formed on the body of the spray nozzle, and by screws 86. The plate 82 is then secured to the hand tool, as shown in FIG. 4, using a suitable adhesive. The assembly of the valve thus attached to the hand tool is best understood from the exploded view illustrated in FIG. 6. However, it should be understood that the structure and assembly of this valve is exemplary, and that other structures and assemblies may occur to those skilled in the art. Consequently, it is intended that the claims be interpreted to cover such other structures and assemblies, as well as modifications of the present structure and assembly, that may readily occur to those skilled in this art.

What is claimed is:

1. In apparatus for cleaning carpets and the like in an open car wash bay, said apparatus comprising a wet vacuum system for vacuuming dirty water from a carpet through a hand tool connected to the vacuum system by a flexible hose, and said tool having a vacuum nozzle adjacent to an open water spray chamber and a spray nozzle in the chamber connected to a spray valve comprised of a body on the tool for manual control of hot water delivered under pressure by a flexible line, said apparatus further comprising means for pressurizing said hot water only while the wet vacuum system is in use, an improvement comprising a T-fitting connected in said hot water line near said pressurizing means for connecting a cold water line at low pressure and flow rate to said hot water line, a moveable control element in the body of said spray valve which closes against a valve set in said body under the pressure of said hot water to block flow of hot water into said open water spray chamber of said tool, means passing through said body for manually unseating said control element against said hot water pressure, and spring means in said valve body for unseating said control element while the hot water is not being pressurized to allow water from said cold water line to flow through said valve while the wet vacuum system is not in use.

2. The improvement as defined in claim 1 including a timer for turning on said pressurizing means for a predetermined interval, and for simultaneously turning on said wet vacuum system.

3. The improvement as defined in claim 1 wherein said means passing through said body for manually unseating said control element against said pressurized water is comprised of a valve stem having its axis along the direction of motion of said control element and extending from said control element through said valve seat and a chamber in said body, and passing through a wall of said body, and a coiled spring around said valve stem, said coiled spring being compressed between said control element and said wall of said body through which said stem passes.

4. In apparatus for delivering hot water under pressure through a hand tool connected to means for pressurizing said water only while said hand tool is in use, and cold water from a low pressure line of low flow rate when said hand tool is not in use, the combination comprising a T-fitting connected in said pressurized hot water line near said pressurizing means for connecting said cold water line at low pressure and flow rate to said hot water line, a valve comprised of a body attached to said hand tool and having a control element which closes against a valve seat in said body under the pressure of hot water in said pressurized line to block flow of pressurized hot water through said hand tool, means passing through said body for manually unseating said control element against hot water in said pressurized line, and spring means in said body for unseating said control element while the pressurizing means is not operating to pressurize water, thereby to allow cold water from said low pressure water line to flow through said valve at low pressure and flow rate.

5. In apparatus as defined in claim 4 wherein said means passing through said body for manually unseating said control element against hot water in said pressurized line is comprised of a valve stem having its axis along the direction of motion of said control element and extending from said control element through said valve seat and a chamber in said body, and passing through a wall of said body, and a coiled spring around said valve stem, said coiled spring being compressed between said control element and said wall of said body through which said stem passes.

* * * * *